US012465127B2

(12) United States Patent
Ceva

(10) Patent No.: US 12,465,127 B2
(45) Date of Patent: Nov. 11, 2025

(54) HAIRDRYER

(71) Applicant: GA.MA S.R.L, San Prieto in Casale (IT)

(72) Inventor: Carlos Jose Ceva, San Prieto in Casale (IT)

(73) Assignee: GA.MA S.R.L, San Prieto in Casale (IT)

( * ) Notice: Subject to any disclaimer, the term of this patent is extended or adjusted under 35 U.S.C. 154(b) by 844 days.

(21) Appl. No.: 17/754,946

(22) PCT Filed: Nov. 3, 2020

(86) PCT No.: PCT/IB2020/060292
§ 371 (c)(1),
(2) Date: Apr. 16, 2022

(87) PCT Pub. No.: WO2021/090155
PCT Pub. Date: May 14, 2021

(65) Prior Publication Data

US 2022/0378166 A1 Dec. 1, 2022

(30) Foreign Application Priority Data

Nov. 4, 2019 (IT) ..... 102019000020314

(51) Int. Cl.
*A45D 20/12* (2006.01)

(52) U.S. Cl.
CPC ..... *A45D 20/122* (2013.01)

(58) Field of Classification Search
CPC ..... A45D 20/12; A45D 20/122
USPC ..... 34/95–100
See application file for complete search history.

(56) References Cited

U.S. PATENT DOCUMENTS 4,668,855 A * 5/1987 Wilson ..... A45D 20/12 392/385
5,832,624 A * 11/1998 Narrin ..... F16M 13/00 34/97
6,199,295 B1 * 3/2001 Smal ..... A45D 20/122 34/98

(Continued)

FOREIGN PATENT DOCUMENTS

CA 3155330 A1 * 5/2021 ..... A45D 20/10
EP 0284690 10/1988

(Continued)

*Primary Examiner* — Stephen M Gravini
(74) *Attorney, Agent, or Firm* — Defillo & Associates, Inc.; Evelyn A. Defillo

(57) ABSTRACT

A hairdryer includes a casing having a main body having a main through cavity containing an electric motor and a fan to generate an air flow with a settled speed; an inner diffuser inside the main through cavity at the front outlet opening of main body and includes a through cavity having a passage section decreasing towards the front outlet opening to increase the speed of the air flow; the main body includes at least one side opening at the front outlet opening to enable air from outside entering into the main through cavity to increase an air output flow rate from the front outlet opening; an outer outlet element is reversibly coupled to the front outlet opening and includes an outflow tubular portion and a coupling tubular portion inserted into the front outlet opening to close the side opening and prevent the air from entering the main through cavity.

13 Claims, 6 Drawing Sheets

(56) References Cited

U.S. PATENT DOCUMENTS

| | | | | |
|---|---|---|---|---|
| 10,660,487 | B1 * | 5/2020 | Borja | A45D 20/16 |
| 11,622,611 | B2 * | 4/2023 | Depoyian | A45D 20/12 34/97 |
| 11,672,318 | B2 * | 6/2023 | Wang | A45D 20/10 34/89 |
| 11,751,658 | B2 * | 9/2023 | Fang | A45D 20/122 34/283 |
| D1,028,348 | S * | 5/2024 | Liu | D28/13 |
| 12,137,784 | B2 * | 11/2024 | Chen | A45D 20/12 |
| 12,156,578 | B2 * | 12/2024 | Kuzia | A45D 20/12 |
| 2011/0010958 | A1 * | 1/2011 | Clark | A45D 20/10 34/97 |
| 2018/0042356 | A1 | 2/2018 | Pavis | |
| 2022/0378166 | A1 * | 12/2022 | Ceva | A45D 20/12 |
| 2025/0049193 | A1 * | 2/2025 | Ban | A45D 20/10 |

FOREIGN PATENT DOCUMENTS

| | | | | |
|---|---|---|---|---|
| EP | 1985197 | | 10/2008 | |
| KR | 20220092943 | A * | 7/2022 | |
| WO | WO2012076885 | | 6/2012 | |
| WO | WO2018021309 | | 2/2018 | |
| WO | WO-2021090155 | A1 * | 5/2021 | A45D 20/10 |

* cited by examiner

HAIRDRYER

CROSS REFERENCE TO RELATED APPLICATION

This application is a national stage entry of PCT/IB2020/060292 filed Nov. 3, 2020, under the International Convention and claiming priority over Italian Patent Application No. 102019000020314 filed Nov. 4, 2019.

TECHNICAL FIELD

The present invention relates to hairdryer devices and in particular refers to a portable hair dryer provided with an inner diffuser of air.

PRIOR ART

The known and widely used portable hairdryers on the market, intended for both professional and domestic use, are electrical devices equipped with an external casing commonly made of plastic material, provided with a handle and a hollow body forming a through duct for air.

In the most common embodiment, an electric motor, a centrifugal or axial fan, which is connected to and rotated by the electric motor, and one or more electric heating elements, in particular resistors or electric resistances, for heating the air are housed inside the hairdryer casing, more precisely in the hollow body forming the air duct.

When the hair dryer is in use, i.e. when the electric motor and the electric heating resistances are supplied with electric current, the fan is rotated by the electric motor and generates inside the air duct a flow of air, which is sucked into the rear part of the hair dryer through a suction opening, flows towards the front part of the hairdryer and outflows from a front opening or outlet opening. The air flow passes through the electric heating resistances, which with the passage of electric current produce heat by Joule effect, thus it heats up and outflows from the outlet opening.

The electric motor of the hairdryer is generally of the commutator type and comprises a stator fixed to the casing and provided with stator windings supplied with single-phase direct or alternating electric current, a rotor provided with rotor or armature windings and rotatably positioned inside the stator and aligned therewith and a commutator or switch fixed to the rotor and engaged by a pair of brushes for supplying the rotor windings with single-phase direct or alternating electric current during the rotation of the rotor for generating the magnetic fields necessary for the operation of the motor. Rotor and stator are made of ferromagnetic material and have larger dimensions the greater the power required to operate the fan to generate an air flow adapted to dry hair in a reasonably short amount of time. Since the casing and fan, made of plastic material, and the resistive wires forming the electrical resistances have a reduced weight, it is evident that the overall weight of the hairdryer is substantially due to the weight of the electric motor.

It is known that the prolonged use of a powerful but bulky hairdryer, especially by professionals in the field of hairstyling which keep their upper limbs raised for long periods of time and perform cyclically repetitive movements, can lead to harmful consequences on muscles and tendons of the hand-wrist-elbow-shoulder system, in some cases with the risk of the inflammatory diseases and osteo-articular pains becoming chronic.

In fact, medical studies have shown that almost 40% of hairdressers suffer from diseases of the musculoskeletal system, in particular related to posture or the biomechanical overload of the upper limbs.

In order to reduce the incidence of diseases of the musculo skeletal system in the population of hairdressers, in addition to measures such as maintaining correct posture during work and rotating work tasks with greater and less functional commitment, the use of manageable and lightweight hairdryers, which weigh little or nothing on the hand-wrist-elbow-shoulder system, is of fundamental importance.

The trend in the sector is therefore to increasingly reduce the overall size and weight of hairdryers without, however, decreasing the power with which the fan is operated and generated an adequate quantity or flow of air, in other words without increasing the time needed to dry hair.

SUMMARY OF THE INVENTION

An object of the present invention is to provide a hairdryer which overcomes the disadvantages of the known hairdryers.

Another object is to provide a manageable and lightweight hairdryer, which can be used for long periods of time weighing little or nothing on the muscles and tendons of the hand-wrist-elbow-shoulder system.

A further object is to provide a powerful hairdryer capable of delivering a high air flow in order to dry hair in reasonably little time.

Another further object is to provide a hairdryer which allows to vary the air flow precisely and in a wide range of adjustments to dry hair according to different needs.

These and other objects are achieved by a hairdryer according to claim 1.

BRIEF DESCRIPTION OF THE DRAWINGS

The invention can be better understood and implemented with reference to the attached drawings which illustrate an exemplifying and non-limiting embodiment thereof, in which.

DETAILED DESCRIPTION OF THE INVENTION

Figure 1:
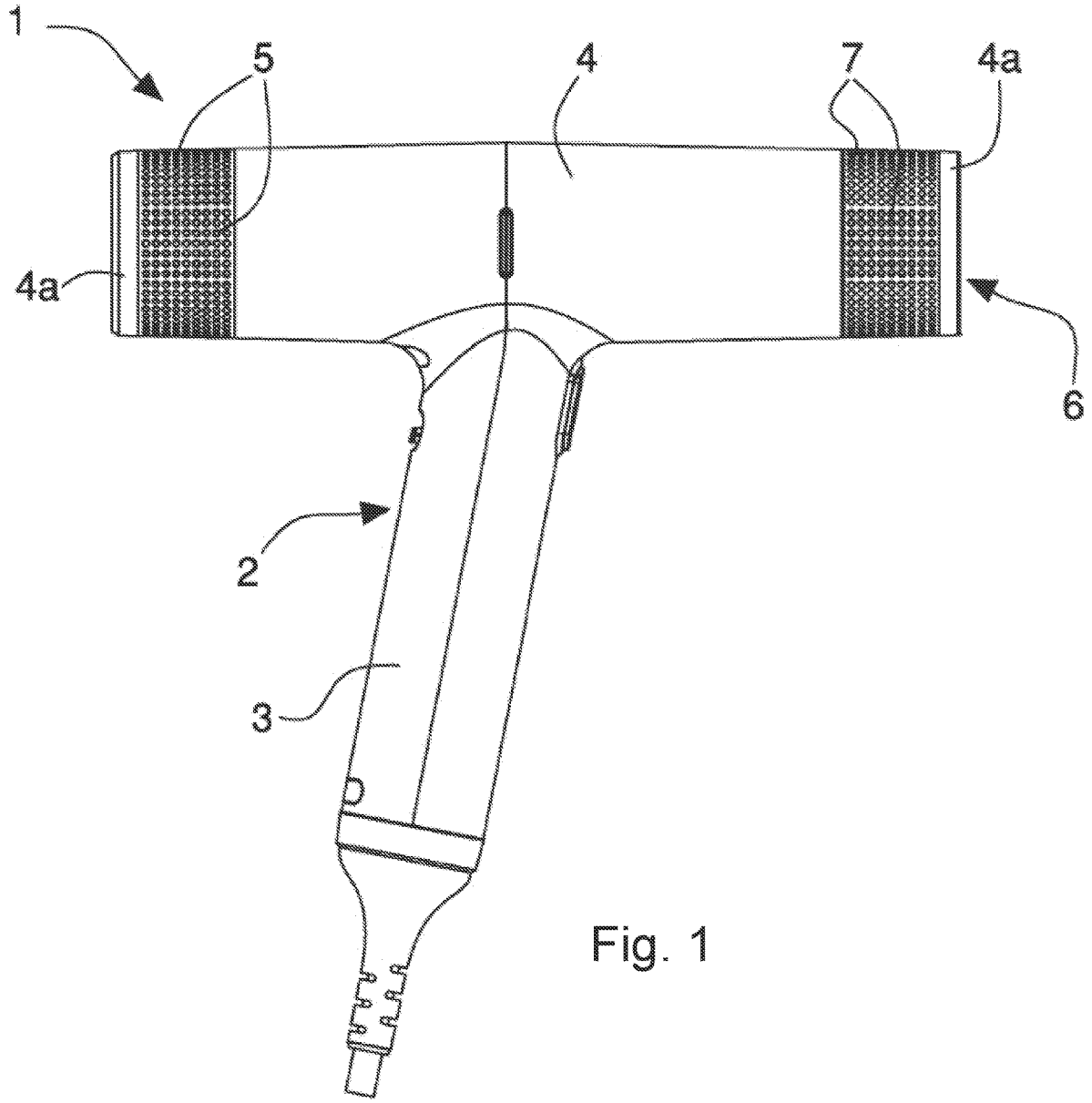
FIG. 1 is a side view of the hairdryer of the invention.
Figure 2:
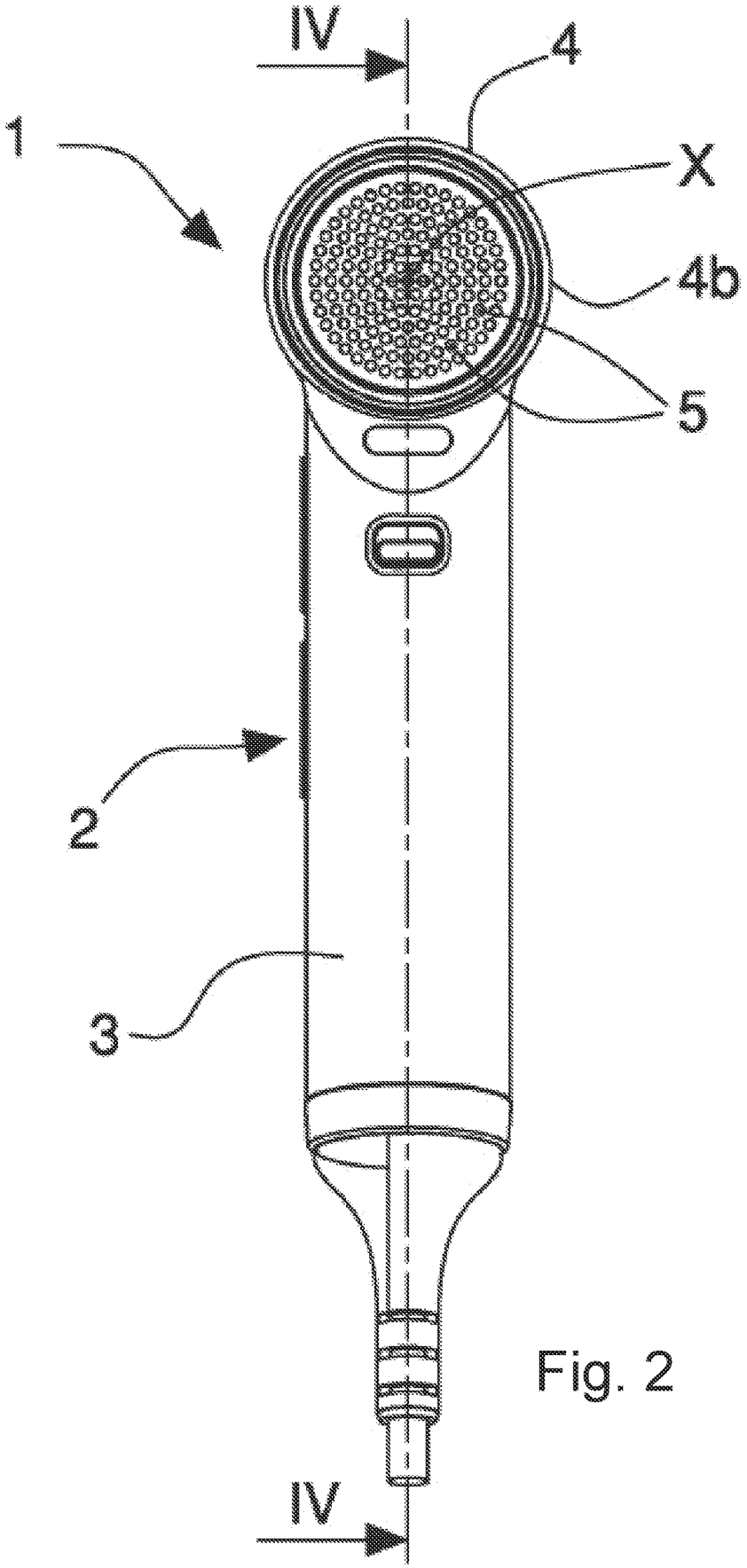
FIG. 2 is a rear view of the hairdryer of FIG. 1.

With reference to FIGS. 1 to 4, a hairdryer 1 according to the present invention is illustrated which comprises a casing 2 provided with a handle 3 and a main body 4 having a main through cavity 13 provided with one or more rear suction openings 5 and a front outlet opening 6, respectively for the inlet and outlet of air. The main body 4, for example, has a substantially cylindrical shape, the same as the main through cavity 13 thereof and extends along a longitudinal axis X.

The main body 4 is adapted to contain within the aforementioned main through cavity 13 an electric motor 20 and a fan 21 drivable in rotation by the electric motor 20 in order to generate an air flow F with a settled speed inside the main through cavity 13, in particular parallel to the longitudinal axis X.

Inside the main body 4 heating means 22 are also provided, positioned downstream of the electric motor 20 and the fan 21 with reference to the air flow F. The heating means 22 comprise resistive wire means adapted to produce heat when supplied by an electric current.

The electric motor 20, the fan 21 and the heating means 22 are components of known type and are therefore not described in further detail.

The air flows through the main through cavity 13, sucked by the fan 21 through the rear 15 suction openings 5 and is conveyed out of the casing 2 through the heating means 22 and the front outlet opening 6.

The hairdryer 1 further comprises an inner diffuser 15 arranged inside the main through cavity 13 and at the front outlet opening 6 and provided with a respective through cavity 14 having a passage section (transversal, i.e. orthogonal, to the longitudinal axis X) decreasing towards the front outlet opening 6 in order to increase the speed of the air flow F due to the known Venturi effect.

The main body 4 at the front outlet opening 6 further comprises one or more side openings 7 through which air can be sucked from the outside of the casing 2 into the main through cavity 13 due to the Venturi effect, in particular due to the air entrainment process generated by the air flow F coming out from the inner diffuser 15 at high speed, so than an air output flow rate Q2 from the outlet opening 6 is increased, as better explained below.

In this manner the air output flow rate Q2 can be increased by 50%-100% compared to an air initial flow rate Q1 generated by the fan 21.

Figure 3:
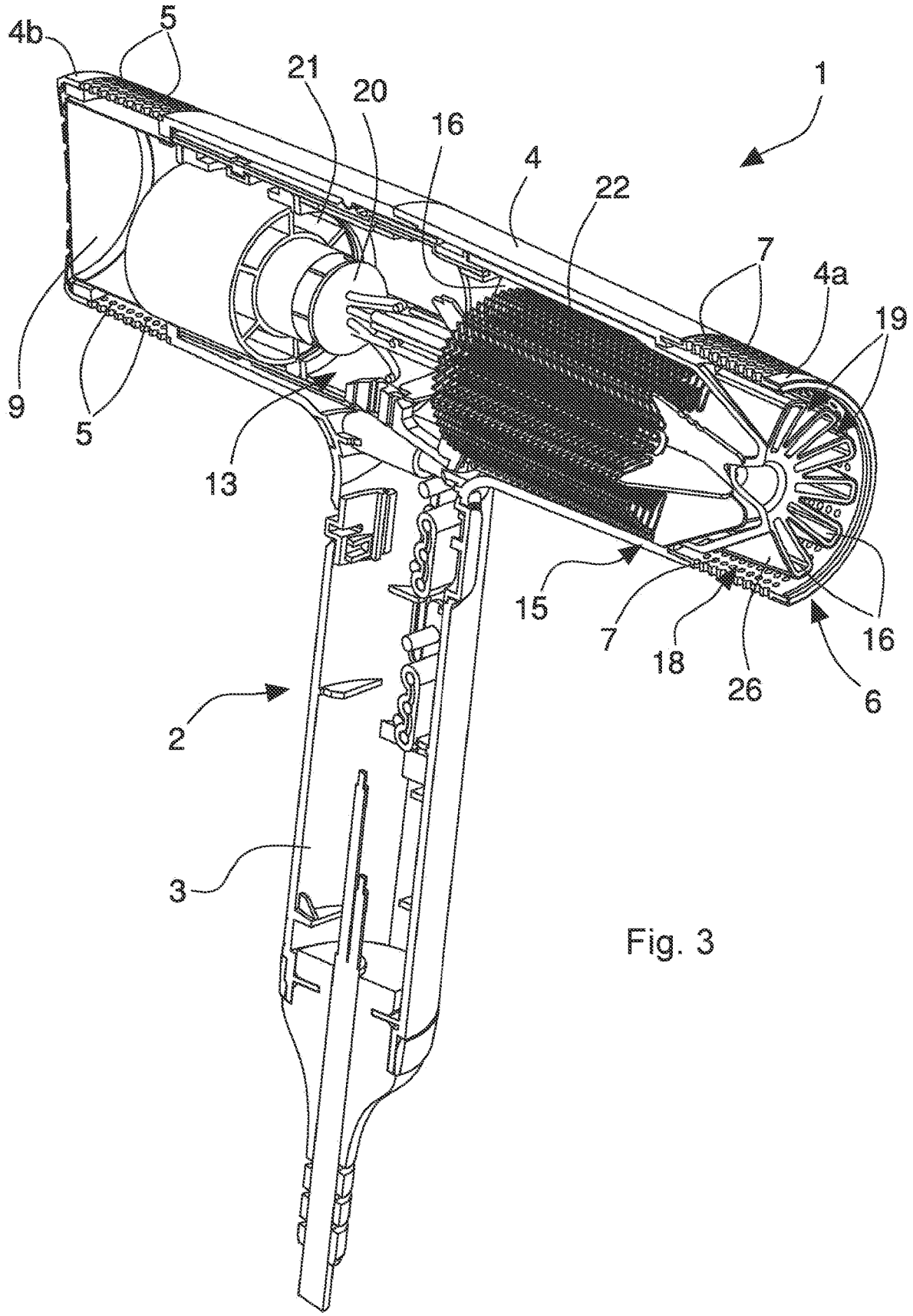
FIG. 3 is a perspective and longitudinal section view of the hairdryer of FIG. 1.
Figure 4:
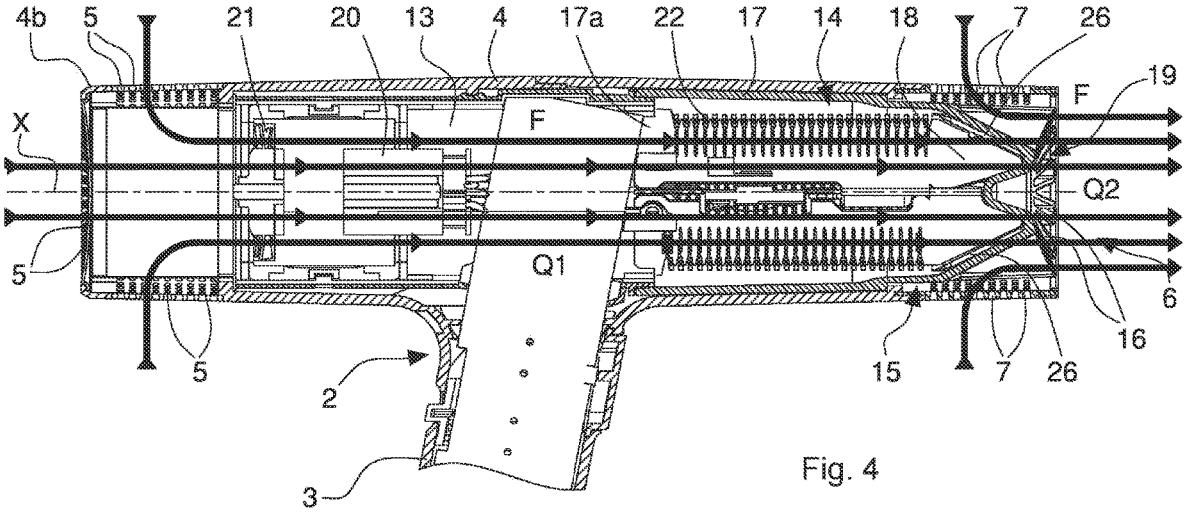
FIG. 4 is a section interrupted along the line Iv-Iv of FIG. 2.

With particular reference to FIGS. 3 and 4, the inner diffuser 15 comprises an inner tubular portion 17, in particular almost cylindrical, provided with an inlet opening 17*a* and having a first transversal passage section for the air flow F entering and coming from the fan 21 and an outer tubular portion 18 having at least one outflow mouth 16 for the air flow F coming out and having a second transversal passage section, the latter having an area equal to 30%-50% of the area of the first transversal passage section. More precisely, the through cavity 14 of the inner diffuser 15 is formed by the respective cavity of the inner tubular portion 17 and the respective cavity of the outer tubular portion 18.

In the illustrated embodiment, the heating means 22 are housed in the through cavity 14 of the inner diffuser 15, in particular within the inner tubular portion 17. Alternatively, they may be fixed outside of the inner diffuser, the latter having an inner tubular portion 17 of shorter length.

In the illustrated embodiment, the outer tubular portion 18 of the inner diffuser 15 comprises a plurality of outflow mouths 16 arranged angularly spaced around the longitudinal axis X of the main body 4, the transversal passage sections of the outflow mouths 16 having an overall area equal to the area of second transversal passage section, that is smaller than the first transversal passage section for the inlet of the air flow F.

More precisely, the outer tubular portion 18 of the inner diffuser 15 comprises a plurality of outflow ducts 26 (the inner cavities of the outflow ducts forming the respective inner cavity of the outer tubular portion 18), each of which is provided with a respective outflow mouth 16. The outflow ducts 26 are arranged radially around the longitudinal axis X and shaped so that two adjacent outflow ducts 26 are separated by a respective groove 19, the latter in particular convergent towards the front outlet opening 6.

In order to ensure an adequate air flow rate inside the main body 4 at the front outlet opening 6, said main body 4 comprises in the illustrated embodiment a plurality of through side openings 7, in the form of holes, made in several parallel and circumferential rows, on a side wall of a front portion 4*a* of the main body 4, the front portion 4*a* comprising said front outlet opening 6.

Likewise, in order to ensure adequate air suction by the fan 21, the main body 4 comprises a plurality of rear suction openings 5 made on a respective rear portion 4*b* of said main body 4. More precisely, the rear suction openings 5 comprise a plurality of holes made on a side wall and on a rear wall of the main body 4 at the respective rear portion 4*b*. A micro-perforated filter element 9 is provided inside the main body 4 in the rear portion 4*b* to filter incoming air through the rear suction openings 5 and retain foreign bodies, dust, corpuscles and dirt which could dirty and clog the fan 21, the motor 20 and the heating means 22.

The hairdryer 1 further includes control means 25, of a known type and not illustrated and described in detail, capable of controlling the rotation speed of the electric motor 20 and therefore of the fan 21 in order to adjust the speed of the air flow F inside the main through cavity 13 before the inner diffuser 15.

Figure 5:
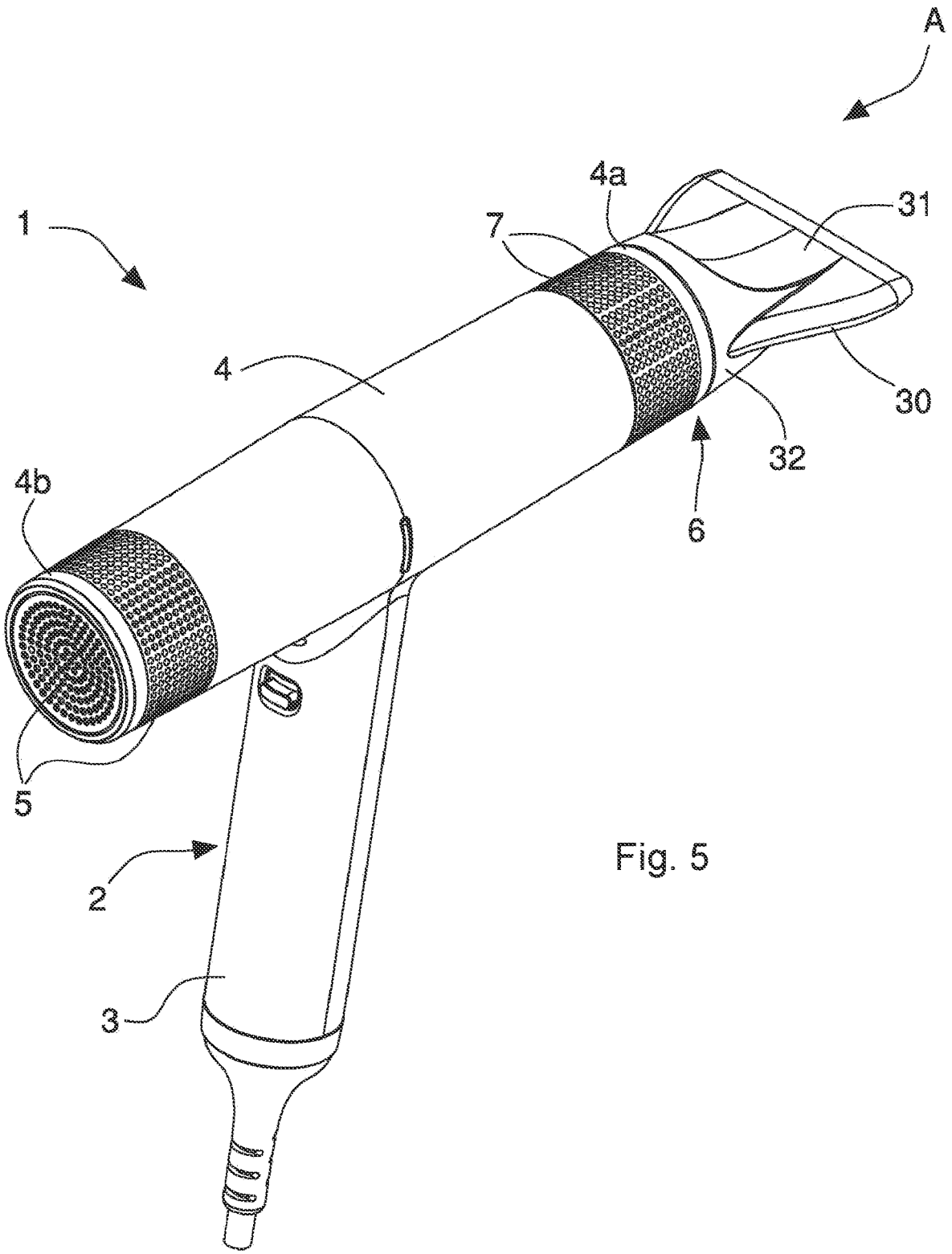
FIG. 5 is a perspective view of the hairdryer of FIG. 1 provided with an outer air nozzle in an assembly configuration.
Figure 6:
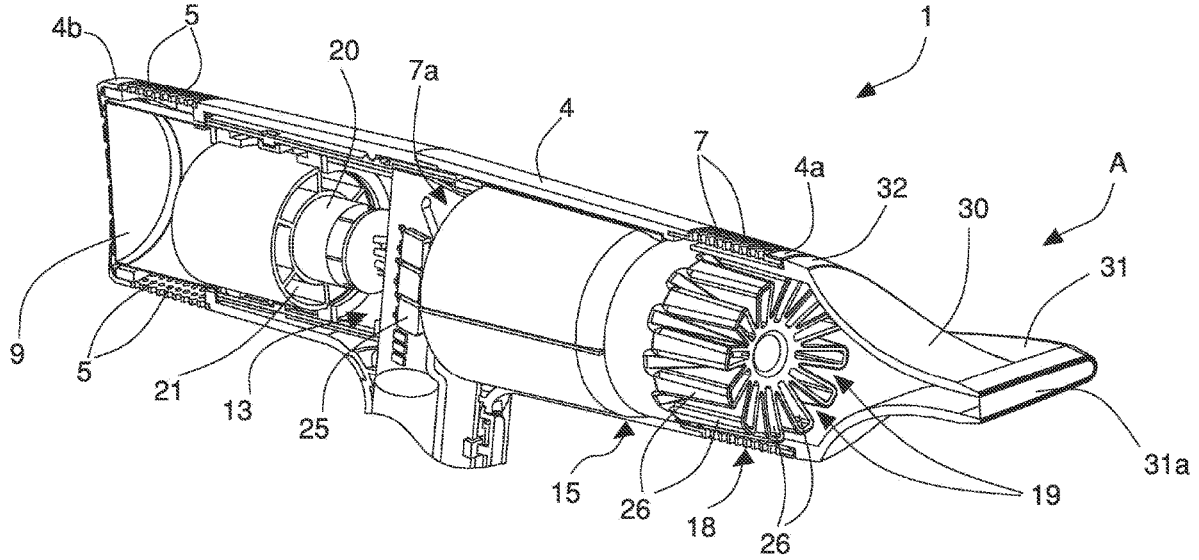
FIG. 6 is an interrupted perspective and longitudinal section view of the hairdryer of FIG. 5.

As illustrated in FIGS. 5 and 6, the hairdryer 1 of the invention further comprises an outer outlet element 30, which can be reversibly coupled to the front outlet opening 6 of the main body 4 in an assembly configuration A.

The outer outlet element 30 comprises an outflow tubular portion 31 of the air flow F and a coupling tubular portion 32, in particular having a cylindrical shape, adapted to be inserted, in particular with a slight interference fit, into the front outlet opening 6. The length of the coupling tubular portion 32 is such as to close the side through openings 7 in order to prevent the air from entering in the main through cavity 13 due to the air entrainment process and to have an air output flow rate Q2 at the front outlet opening 6 that is substantially equal to an air initial flow rate Q1 generated by the fan 21. At the same time, by closing the side through openings 7 the pressure of the air coming out from the inner diffuser 15 is maintained unchanged.

In the embodiment illustrated in FIGS. 5 and 6, the outer outlet element 30 comprises a nozzle of known type having an outflow tubular portion 31 with varying shape and size and an inner section that decreases and converges towards a respective outflow opening 31*a* so as to increase the speed of the outflow of air, in this case the air flow rate generated by the fan 21 remaining constant. For example, the outflow opening 31*a* has an elongated rectangular shape.

The section or area of the outflow opening 31*a* of the outflow tubular portion 31 is, for example, substantially equal to the area of the second transversal passage section of the inner diffuser 15 i.e., the overall area of the outflow mouths 16 of the outflow ducts 26. The outflow opening 31*a* can have shapes other than rectangular and areas less than or greater than the overall area of the outflow mouths 16 of the outflow ducts 26. For example, the outer outlet element can comprise a diffuser having an outflow tubular portion 31 of varying shape and a section that increases and diverges towards one or more outflow openings having an overall area greater than the overall area of the outflow mouths 16 of the outflow ducts 26, so as to decrease the speed of the air flow coming out.

In the operation of the hairdryer 1 of the invention, the air sucked by the fan 21 through the rear suction openings 5 and conveyed through the main through cavity 13 reaches the inner diffuser 15, which has a respective through cavity 14 having a passage section decreasing towards the front outlet opening 6, in order to increase the speed of the air flow F due to the known Venturi effect.

As a further consequence, through the plurality of side openings 7 made on the side wall of the front portion 4*a* of the main body 4, the air is sucked from outside of the hairdryer 1 towards the inside of the main through cavity 3 due to the known Venturi effect and in particular due to the air entrainment process generated by the air flow F coming out of the inner diffuser 15 at high speed and the consequent local decrease of pressure at the output of the inner diffuser 15 (according to Bernoulli's theorem). Therefore, an additional flow rate of air sucked and dragged through the through side openings 7 is added to the air initial flow rate Q1 generated by the fan 21 so as to considerably increase the air output flow rate Q2 from the front outlet opening 6.

Suction or dragging of air from the side openings 7 is also facilitated by the shape of the outer tubular portion 18 of the inner diffuser 15 which comprises a plurality of outflow ducts 26 separated from each other by respective grooves 19, having a converging shape towards the front outlet opening 6. Said converging grooves 19, in addition to facilitating suction of the air from the side openings 7, allow the conveyance of the air with radial concentric motion towards the inside of the main through cavity 3, parallel to the longitudinal axis X.

Tests carried out by the applicant have shown that thanks to the specific configuration of the inner diffuser 15 and the side openings 7 the air output flow rate Q2 of the hairdryer of the invention can be increased by 50%-100% compared to the air initial flow rate Q1 generated by the fan 21.

Thanks to the hairdryer 1 of the invention provided with an inner diffuser 15 and side openings 7 which exploit the known Venturi effect and air entrainment process, it is therefore possible to significantly increase the air flow rate supplied without the need to increase the power, i.e., size and weight of the electric motor 20. In this way, while having a hairdryer which ensures a high flow rate, for example between 60 and 110 m3/h, so as to dry hair in reasonably little time, it is possible to have an appliance which is compact, manageable and of a small weight and size, which can be used for long periods of time weighing little or nothing on the muscles and tendons of the hand-wrist-elbow-shoulder system.

The use of the outer out element 30, adapted to inhibit the Venturi effect and the air entrainment process by closing the side openings 7, also allows to reduce the air output flow rate Q2 of the hairdryer 1 of the invention which is therefore substantially equal to the air initial flow rate Q1 generated by the fan 21, whose speed (and therefore whose air flow rate) 30 can still be precisely varied by the control means 25, which allow to control the rotation speed of the electric motor 20.

The hairdryer 1 of the invention therefore allows to vary precisely and in a wide adjustment range the air flow rate to dry hair according to different and specific needs also using or not using the outer outlet element 30.

The invention claimed is:

1. A hairdryer (1) comprising:

a casing (2) provided with a handle (3) and a main body (4) having a main through cavity (13) provided with at least one rear suction opening (5) and a front outlet opening (6);

at least one electric motor (20) and a fan (21) enclosed in said main through cavity (13), said fan (21) being drivable in rotation by said electric motor (20) to generate an air flow (F) with a settled speed inside said main through cavity (13);

an inner diffuser (15) arranged inside said main through cavity (13) at said front outlet opening (6) and provided with a respective through cavity (14) having a passage section decreasing towards said front outlet opening (6) in order to increase the settled speed of said air flow (F), said main body (4) comprising at least one side opening (7) at said front outlet opening (6) to enable air from outside coming into said main through cavity (13) due to drag effect generated by said air flow (F) coming out from said inner diffuser (15) at a high speed so that an air output flow rate (Q2) from said front outlet opening (6) is increased;

an outer outlet element (30) reversibly coupled to said front outlet opening (6) of said main body (4) in an assembly configuration (A) and comprising an outflow tubular portion (31) of the air flow (F) and a coupling tubular portion (32) adapted to be inserted in said front outlet opening (6) and long enough to close said at least one side opening (7) in order to prevent air from entering in said main through cavity (13) due to drag effect and to have an air output flow rate from the outflow tubular portion (31) that is substantially equal to an air initial flow rate (Q1) generated by said fan (21).

2. The hairdryer (1) according to claim 1, wherein said inner diffuser (15) comprises an inner tubular portion (17) provided with an inlet opening (17*a*) having a first transversal passage section for said air flow (F) entering and an outer tubular portion (18) having at least an outflow mouth (16) with a second transversal passage section for said air flow (F) coming out, said second transversal passage section having a surface equal to 30-50% of a surface of said first transversal passage section.

3. The hairdryer according to claim 2, wherein said outer tubular portion (18) of said inner diffuser (15) comprises a plurality of outflow mouths (16) arranged angularly spaced about a longitudinal axis (X) of said main body (4), transversal passage sections of each outflow mouth (16) having overall surface equal to a surface of said second transversal passage section.

4. The hairdryer (1) according to claim 3, wherein said outer tubular portion (18) of said inner diffuser (15) comprises a plurality of outflow ducts (26) provided with respective outflow mouths (16) and arranged radially around said longitudinal axis (X), wherein adjacent outflow ducts (26) are separated by a groove (19).

5. The hairdryer (1) according to claim 1, wherein said main body (4) comprises a plurality of side openings (7) made on a side wall of a front portion (4*a*) of said main body (4).

6. The hairdryer (1) according to claim 1, wherein said outflow tubular portion (31) of said outer outlet element (30) has inner section decreasing and convergent towards a respective outflow opening (31*a*).

7. The hairdryer r (1) according to claim 1, wherein said outflow tubular portion (31) of said outer outlet element (30) has inner section increasing and divergent towards at least one respective outflow opening.

8. The hairdryer r (1) according to claim 1, wherein said main body (4) comprises a plurality of rear suction first openings (5) made on a respective rear portion (4*b*) of said main body (4).

9. The hairdryer (1) according to claim 1, wherein said main body (4) is substantially cylindrical shaped and extends along a longitudinal axis (X).

10. The hairdryer (1) according to claim 1, comprising air heating device (22) having a resistive wire device adapted to produce heat when supplied by an electric current.

11. The hairdryer (1) according to claim 10, wherein said heating device (22) are located inside said main body (4) downstream said electric motor (20) and said fan (21) with reference to the air flow (F).

12. The hairdryer (1) according to claim 10, wherein said heating device (22) are located in said inner tubular portion (17) of said inner diffuser (15).

13. The hairdryer (1) according to claim 1, comprising a control device (25) to control at least one rotation speed of said electric motor (20) and adjust the speed of said air flow (F) inside the main through cavity (13) before the inner diffuser (15).

* * * * *